US007686175B2

(12) United States Patent
Waisanen

(10) Patent No.: US 7,686,175 B2
(45) Date of Patent: Mar. 30, 2010

(54) CONTAINER CRANE

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 45 days.

(21) Appl. No.: 11/574,607

(22) PCT Filed: Sep. 2, 2005

(86) PCT No.: PCT/US2005/031369

§ 371 (c)(1),
(2), (4) Date: Dec. 27, 2007

(87) PCT Pub. No.: WO2006/028994

PCT Pub. Date: Mar. 16, 2006

(65) Prior Publication Data

US 2008/0251485 A1 Oct. 16, 2008

Related U.S. Application Data

(60) Provisional application No. 60/606,956, filed on Sep. 3, 2004.

(51) Int. Cl.
*B66C 19/00* (2006.01)

(52) U.S. Cl. ..... 212/315; 212/318; 414/543

(58) Field of Classification Search ..... 212/179, 212/180, 315, 318
See application file for complete search history.

(56) References Cited

U.S. PATENT DOCUMENTS

| | | | | | |
|---|---|---|---|---|---|
| 112,829 | A * | 3/1871 | Middleton | 212/317 |
| 1,752,026 | A * | 3/1930 | Phillips | 105/163.1 |
| 2,499,442 | A * | 3/1950 | Wright | 414/543 |
| 2,704,037 | A * | 3/1955 | Babcock et al. | 104/98 |
| 2,846,081 | A * | 8/1958 | Moore et al. | 212/317 |
| 3,006,485 | A * | 10/1961 | Martin | 414/542 |
| 3,572,513 | A * | 3/1971 | Tantlinger et al. | 212/180 |
| 3,770,137 | A * | 11/1973 | Slutsky et al. | 212/315 |
| 4,187,048 | A * | 2/1980 | Bohlmann | 414/542 |
| 4,249,853 | A * | 2/1981 | Lyvers | 414/543 |
| 4,289,076 | A * | 9/1981 | Miller | 105/163.1 |
| 4,360,307 | A * | 11/1982 | Larsson | 414/542 |
| 4,639,182 | A * | 1/1987 | Inaba et al. | 414/543 |
| 4,930,970 | A * | 6/1990 | Sunderland | 414/542 |
| 6,860,703 | B2 * | 3/2005 | Carroll, Jr. | 414/543 |
| 6,886,811 | B2 * | 5/2005 | Springett et al. | 254/264 |

FOREIGN PATENT DOCUMENTS

| | | | |
|---|---|---|---|
| GB | 2 206 097 A | * | 12/1988 |
| GB | 2 387 832 A | * | 10/2003 |
| SU | 863507 | * | 9/1981 |
| SU | 1463701 A | * | 3/1989 |

* cited by examiner

*Primary Examiner*—Thomas J. Brahan
(74) *Attorney, Agent, or Firm*—Porter, Wright, Morris & Arthur, LLP

(57) ABSTRACT

A container crane includes a container including first and second side walls spaced apart and generally parallel, a bridge adapted to travel in a substantially longitudinal direction along the first and second side walls, a trolley adapted to travel in a substantially longitudinal direction along the bridge, a jib coupled to a bottom surface of the trolley, and a hoist mounted to the jib.

16 Claims, 3 Drawing Sheets

CONTAINER CRANE

CROSS-REFERENCE TO RELATED APPLICATION

This application claims priority from U.S. Provisional Patent Application No. 60/606,956, entitled "Container Crane", filed Sep. 3, 2004 by Steven K. Waisanen.

BACKGROUND

The present invention relates to a crane for use with a shipping container. More particularly, the present invention relates to a container crane coupled within the container for lifting and moving loads between the inside and the outside of the container.

Large shipping containers are used to store and transport goods. Often, forklifts, other material handlers, or laborers are used to move goods between the inside and the outside of the shipping containers. Further, conventional cranes may be used to lift or place a load near an opening of a shipping container, however such cranes cannot lift or place a load within the shipping container. These methods of loading and unloading are inefficient and increase the cost of loading and unloading goods.

SUMMARY

In one embodiment, the invention provides a container crane including a container including first and second side walls spaced apart and generally parallel, a bridge adapted to travel in a substantially longitudinal direction along the first and second side walls, a trolley adapted to travel in a substantially longitudinal direction along the bridge, a jib coupled to a bottom surface of the trolley, and a hoist mounted to the jib.

In another embodiment, the invention provides a crane for use in lifting and unloading a load to and from a shipping container, the shipping container including two side walls that are spaced apart and generally parallel, each side wall including a support channel. The crane includes a bridge adapted to travel in a substantially longitudinal direction along the support channels, a trolley adapted to travel in a substantially longitudinal direction along the bridge, a jib rotatably coupled to a bottom surface of the trolley and adapted to travel back and forth relative to the trolley, and a hoist adapted to travel along a length of the jib.

In yet another embodiment, the invention provides a container crane including a container including first and second side walls spaced apart and generally parallel and first and second end walls extending between the side walls, each side wall including a main support channel. The container crane also includes a bridge adapted to travel along the support channels, the bridge defining first and second channels aligned transversely to the main support channels wherein the first and second channels are spaced apart and generally parallel. A trolley is adapted to travel along the first and second channels of the bridge, the trolley including a rotatable connector at a bottom surface of the trolley. A jib is coupled to the rotatable connector, wherein the jib rotates with the rotatable connector relative to the trolley and the jib is adapted to move back and forth relative to the trolley. A hoist is adapted to travel along a length of the jib, the hoist being positionable outside the container.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
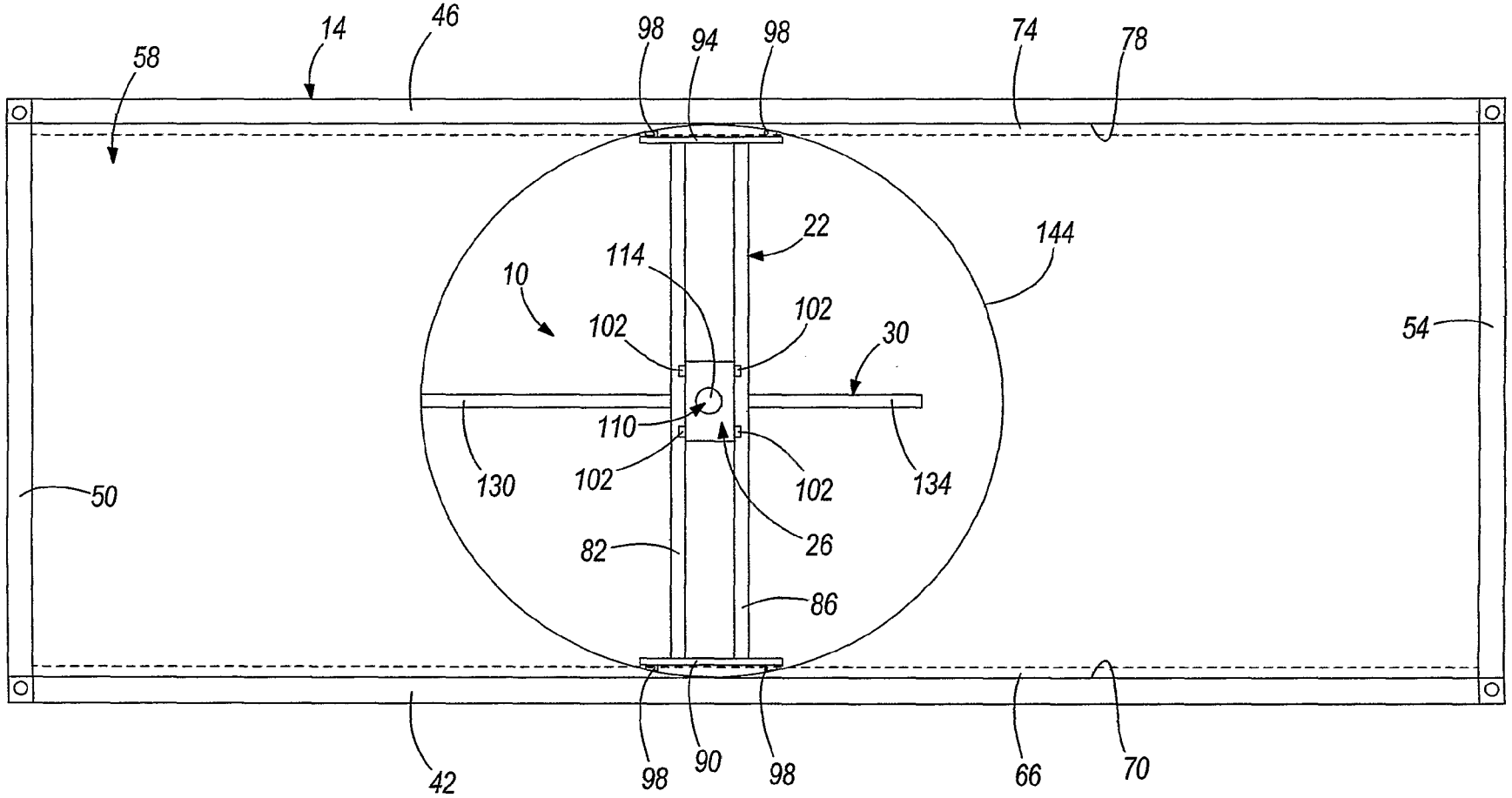
FIG. 1 is a top view of a crane mounted within a shipping container and embodying the invention.
Figure 2:
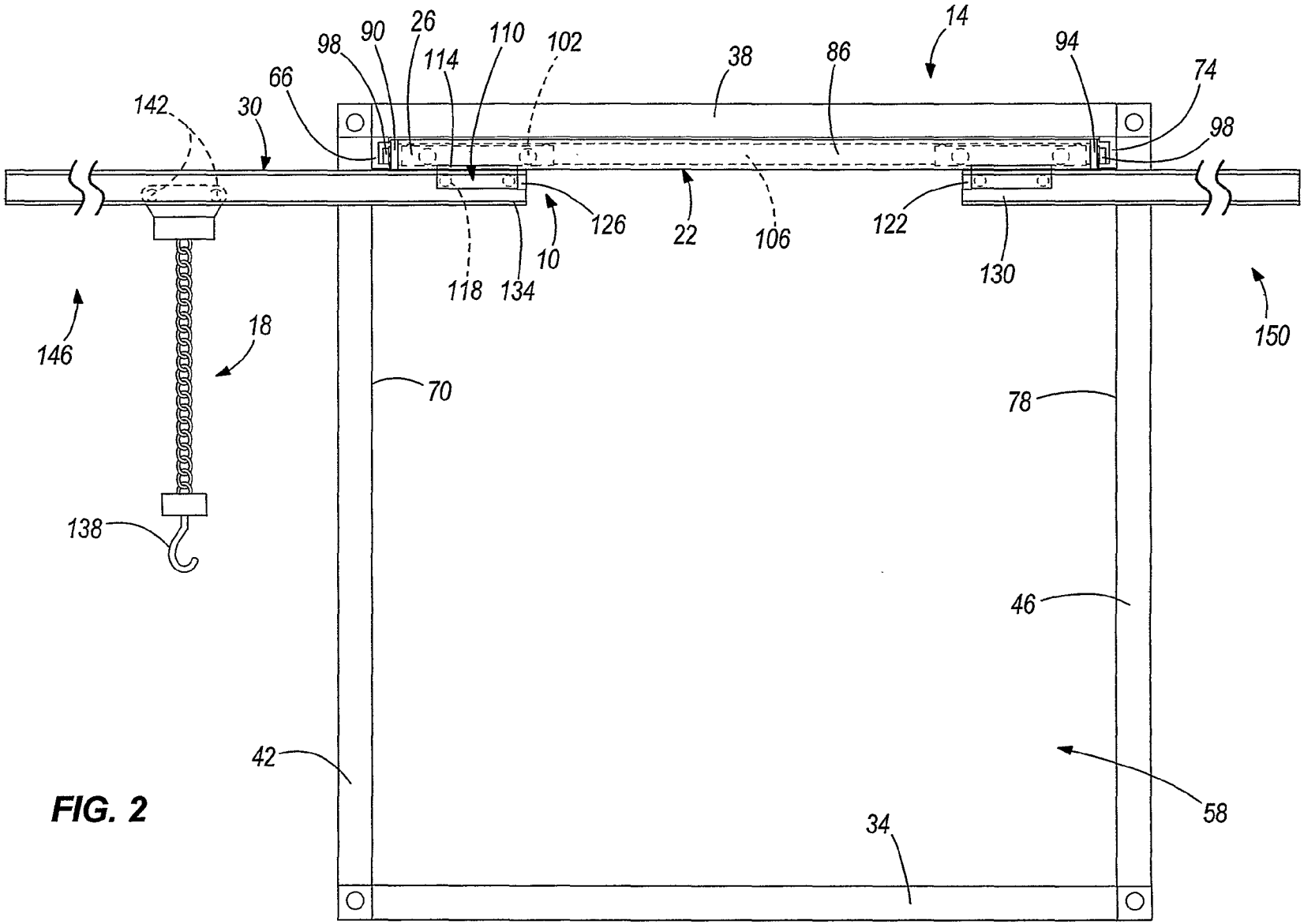
FIG. 2 is a sectional view of the crane and the shipping container taken along line 2-2 of FIG. 1.
Figure 3:
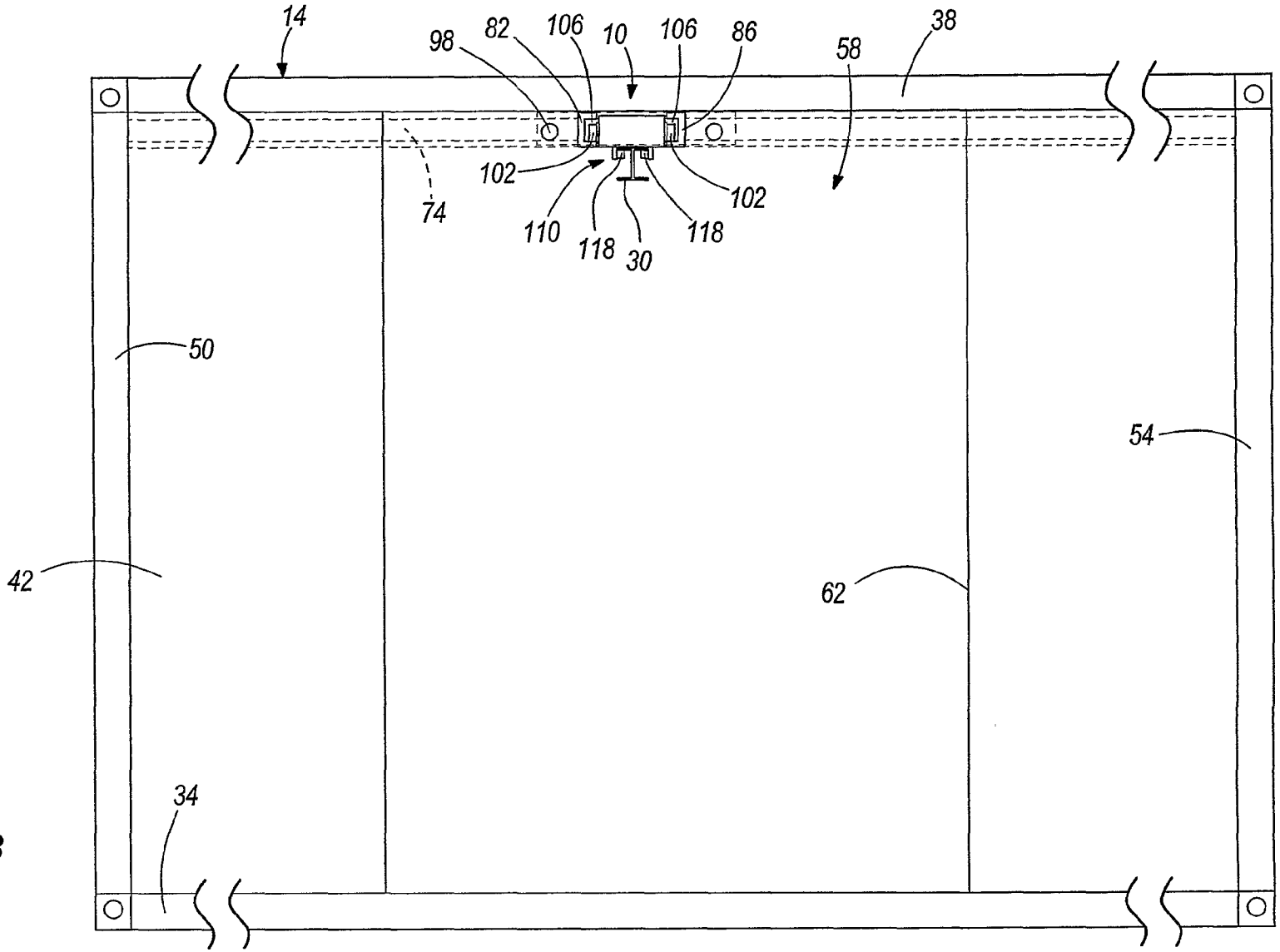
FIG. 3 is a side view of the shipping container with an access door open and illustrating the crane.

FIGS. 1 through 3 illustrate a shipping container crane 10 according to the present invention. The crane 10 is positioned inside a shipping container 14 and positions a hoist 18 (FIG. 2) within the container 14 or outside the container 14 for lifting and moving a load. As shown in FIG. 1, the crane 10 includes a bridge 22, a trolley 26, and a jib 30. The bridge 22 moves along the length of the container 14, the trolley 26 moves along the length of the bridge 22 and a width of the container 14, and the jib 30 is both translatable and pivotal relative to the trolley.

The shipping container 14 includes a base 34 (FIG. 2), a cover 38 (FIG. 2), first and second side walls 42, 46 that are spaced apart and generally parallel, and first and second end walls 50, 54 that extend between the side walls 42, 46, which all define an interior compartment 58 of the container 14. As shown in FIG. 3, each of the first and second side walls 42, 46 includes an opening 62, typically closed by a sliding door (not shown), for gaining access to the interior compartment 58 of the container 14.

In the illustrated embodiment, a first channel 66, or bracket, is mounted to an inner surface 70 of the first side wall 42 of the shipping container 14 and a second channel 74, or bracket, is mounted to an inner surface 78 of the second side wall 46. The first and second channels 66, 74 run substantially the length of the container 14 between the first and second end walls 50, 54 and are positioned at or near a top of the side walls 42, 46 of the container 14. The bridge 22 translates along the first and second channels 66, 74 in a substantially longitudinal direction, to thereby travel substantially the entire length of the container 14.

The bridge 22 includes a first girder 82, a second girder 86, and a pair of end trucks 90, 94 that extend between the first and second girders 82, 86. The end trucks 90, 94 of the bridge 22 include wheels 98 that ride within the channels 66, 74 to facilitate travel of the bridge 22 along the channels 66, 74. The end trucks 90, 94 are aligned generally parallel to the channels 66, 74. In a further embodiment, a motor (not shown) is interconnected with the wheels 98 to drive the wheels 98 and thereby cause movement of the bridge 22 along the channels 66, 74. As will be readily known to those skilled in the art, any number of driven wheels may be disposed on the end trucks 90, 94. Further, idle wheels may be disposed on the end trucks 90, 94 to facilitate travel of the bridge 22 along the channels 66, 74.

The first and second girders 82, 86 are spaced apart from each other and generally parallel, and the girders 82, 86 are aligned transversely to the bridge channels 66, 74. The trolley 26 travels along the girders 82, 86 in a substantially longitudinal direction, generally parallel to the first and second girders 82, 86. The trolley 26 includes wheels 102 that permit the trolley 26 to move relative to the bridge 22. The wheels 102 of the trolley 26 ride in channels 106 defined by the first and second girders 82, 86 of the bridge 22, as best seen in FIG. 3. In this way, the trolley 26 can run substantially the entire length of the bridge 18. In a further embodiment, a motor (not shown) is interconnected with the wheels 102 to drive the wheels 102 and thereby cause movement of the trolley 26 along the first and second girders 82, 86. As will be readily known to those skilled in the art, any number of driven wheels may be disposed on the trolley 26. Further, idle wheels may be disposed on the trolley to facilitate travel of the trolley 26 along the first and second girders 82, 86.

The trolley 26 includes a pivot-with-rollers connector 110 mounted to the trolley 26, and the jib 30 is connected to the trolley 26 through the connector 110. The connector 110 includes a rotate bearing 114 for rotating (i.e., pivoting) the connector 110, and thereby the jib 30, relative to the trolley 26. The jib is capable of rotating 360° in either direction relative to the trolley 26. The connector 110 also includes rollers 118 to allow the jib 30 to roll back and forth relative to the connector 110 and the trolley 26, as best seen in FIG. 2. The jib 30 is coupled to the connector 110, such that the jib 30 rotates with respect to the trolley 26. The jib 30 is of an I-beam construction, a top plate of which rides on the rollers 118, as shown in FIG. 3. Referring to FIG. 2, a first stop member 122 and a second stop member 126 are mounted to the jib 30 at a first end 130 and a second end 134 of the jib 30, respectively. The stop members 122, 126 prevent the jib 30 from traveling off the connector 110 in either direction. In a further embodiment, a motor (not shown) is interconnected with the connector 110 to drive the rotate bearing 114 and cause rotation of the jib 30 relative to the trolley 26, as well as to drive the rollers 118 and cause back and forth movement of the jib 30 relative to the trolley 26.

The hoist 18 is mounted to the jib 30 and is adapted for travel along a length of the jib 30 between the first end 130 and the second end 134. A bottom plate of the I-beam jib 30 defines a rail that the hoist 18 travels along. The hoist 18 includes a vertically movable load hook 138 and wheels 142 to facilitate travel of the hoist 18 along the jib 30. In the illustrated embodiment, the hoist 18 is a chain hoist. In another embodiment, the hoist 18 includes other configurations for lifting, as will also be readily apparent to those of skill in the art. In a further embodiment, a motor (not shown) is interconnected with the wheels 142 to drive the wheels 142 and thereby cause movement of the hoist 18 along the jib 30.

With this arrangement and construction, the jib 30 can move back and forth and rotate relative to the trolley 26, and the trolley 26 can be located virtually anywhere within the shipping container 14. The translation of the trolley 26 with respect to the bridge 22 and the translation of the bridge 22 within the channels 66, 74 running the length of the container 14 provide the range of motion of the trolley 26 throughout the container 14. The hoist 18 (FIG. 2) or other lifting mechanism (not shown) connected to the jib 30 permits a load to be lifted and placed from virtually any location within the container 14. For example, FIG. 1 illustrates a reach area 144 for the crane hoist 18 when the bridge 22, the trolley 26 and the jib 30 are positioned as shown.

As shown in FIG. 3, the shipping container 14 includes the opening 62 in each side wall 42, 46. With the bridge 22 positioned in line with the opening 62 of the container 14, the jib 30 rotated substantially into alignment with the bridge 22, and the trolley 26 positioned toward one of the ends of the bridge 22, the jib 30 is able to reach outside of the container 14 and through the openings 62 of the container 14, as shown in FIG. 2. In FIG. 2, the jib 30 is shown in a position 146 reaching outside the container 14 to the left through the first side wall 42. An alternate position 150 is also shown in FIG. 2, with the jib 30 reaching outside the container 14 to the right through the second side wall 46. Therefore, the hoist 18 attached to the jib 30 can lift a load from outside the container 14 and place it anywhere within the container 14. In the same way, the hoist 18 can lift a load from anywhere within the container 14 and place it outside the container 14.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art. Various features and advantages of the invention are set forth in the following claims.

What is claimed is:

1. A container crane comprising:

a container including first and second side walls spaced apart and generally parallel;

a bridge adapted to travel in a substantially longitudinal direction along the first and second walls;

a trolley adapted to travel in a substantially longitudinal direction along the bridge and substantially perpendicular to the first and second side walls;

wherein the trolley includes wheels that roll along the bridge;

a connector rotatably secured to a bottom of the trolley;

a jib including a horizontally disposed I-beam having a top plate and a bottom plate and supported by the connector so that the jib rotates about a vertical axis relative to the trolley;

wherein the top plate of the jib rides on rollers carried by the connector to longitudinally move the jib back and forth relative to the trolley so that opposed first and second ends the jib can selectively extend away from the trolley;

first and second stops mounted to the first and second ends of the jib respectively to stop the jib from traveling off the connector in either direction;

a hoist mounted to the jib; and wherein the hoist includes wheels that roll along the bottom plate of the jib so that the hoist travels between a first end of the jib and a second end of the jib.

2. The container crane of claim 1, and further comprising a support channel mounted to each side wall, each support channel extending substantially the length of the container, wherein the bridge is adapted to travel along the support channels.

3. The container crane of claim 2 wherein the bridge includes wheels that ride in the support channels so that the bridge travels along the support channels.

4. The container crane of claim 1 wherein the bridge defines channels and the trolley travels in the channels along the length of the bridge.

5. The container crane of claim 4 wherein the wheels of the trolley ride in the channels of the bridge so that the trolley travels along the channels of the bridge.

6. The container crane of claim 1 wherein the connector is a rotatable bearing for rotating the jib relative to the trolley.

7. The container crane of claim 1 wherein the jib is movable relative to the trolley to permit the hoist to be positionable outside the container.

8. The container crane of claim 7 wherein an opening is formed in at least one side wall of the container to accommodate movement of the jib.

9. The container crane of claim 1 wherein the jib has a fixed length.

10. The container crane of claim 9 wherein the length of the jib is less than a length of the bridge.

11. The container crane of claim 1 wherein each of the first and second side walls of the container have an opening and the jib can be selectively extended through each of the openings to position the hoist outside the container.

12. A container crane comprising:

a container including first and second side walls spaced apart and generally parallel and first and second end walls extending between the side walls, each side wall including a main support channel;

a bridge adapted to travel along the support channels, the bridge defining first and second channels aligned transversely to the main support channels wherein the first and second channels are spaced apart and generally parallel;

a trolley adapted to travel along the first and second channels of the bridge, the trolley including a rotatable connector at a bottom surface of the trolley;

wherein the trolley includes wheels that roll along the bridge;

a jib coupled to the rotatable connector and having a fixed length;

wherein the jib includes a horizontally disposed I-beam having a top plate and a bottom plate and supported by the connector;

wherein the jib rotates with the rotatable connector relative to the trolley about a vertical axis;

wherein the top plate of the jib rides on rollers carried by the connector to longitudinally move the jib back and forth relative to the trolley so that opposed first and second ends the jib can selectively extend away from the trolley;

first and second stops mounted to the first and second ends of the jib respectively to stop the jib from traveling off the connector in either direction;

a hoist adapted to travel along a length of the jib, the hoist being positionable outside the container;

wherein the hoist includes wheels that roll along the bottom plate of the jib so that the hoist travels between a first end of the jib and a second end of the jib; and wherein each of the first and second side walls of the container has an opening and the jib can be selectively extended through each of the openings to position the hoist outside the container.

13. The container crane of claim 12 wherein the connector includes a rotatable bearing for rotating the jib relative to the trolley.

14. The container crane of claim 12 wherein the wheels of the trolley ride in the channels of the bridge so that the trolley travels along the channels of the bridge.

15. The container crane of claim 12 wherein the bridge includes wheels that ride in the support channels so that the bridge travels along the support channels.

16. The container crane of claim 12 wherein the length of the jib is less than a length of the bridge.

* * * * *